US007412782B2

(12) United States Patent
Dahlheimer

(10) Patent No.: US 7,412,782 B2
(45) Date of Patent: Aug. 19, 2008

(54) PROCESS FOR THE CONTINUOUS DRYING OF WATER-SURROUNDED GRANULATE

(75) Inventor: Stefan Dahlheimer, Kleinostheim (DE)

(73) Assignee: Rieter Automatik GmbH, Grossostheim (DE)

( * ) Notice: Subject to any disclaimer, the term of this patent is extended or adjusted under 35 U.S.C. 154(b) by 131 days.

(21) Appl. No.: 11/237,696

(22) Filed: Sep. 29, 2005

(65) Prior Publication Data

US 2006/0075655 A1 Apr. 13, 2006

(30) Foreign Application Priority Data

Oct. 13, 2004 (DE) ..... 10 2004 049 863
Nov. 12, 2004 (DE) ..... 10 2004 054 787
Dec. 3, 2004 (DE) ..... 10 2004 058 417

(51) Int. Cl.
*F26B 3/00* (2006.01)

(52) U.S. Cl. ..... 34/491; 34/487; 34/493; 34/500

(58) Field of Classification Search ..... 34/486, 34/491, 500, 179, 203, 210, 216, 217, 487, 34/493
See application file for complete search history.

(56) References Cited

U.S. PATENT DOCUMENTS 1,980,898 A * 11/1934 Abernethy ..... 34/305
2,900,256 A * 8/1959 Everette ..... 34/210
3,611,583 A 10/1971 Anderson et al.
5,098,586 A 3/1992 Rudolph
5,628,947 A 5/1997 Keilert
6,592,350 B1 7/2003 Chszaniecki
2007/0163294 A1 7/2007 Aung et al.

FOREIGN PATENT DOCUMENTS

| | | | |
|---|---|---|---|
| DE | 2045801 | | 3/1972 |
| DE | 3927769 | C1 | 8/1989 |
| DE | 4036112 | A1 | 5/1992 |
| DE | 4036112 | C2 | 5/1992 |
| DE | 4314162 | C1 | 4/1993 |
| DE | 19914116 | A1 | 9/2000 |
| DE | 10129756 | C1 | 6/2001 |
| JP | 51-124853 | | 10/1976 |
| JP | 2-286063 | A | 11/1990 |
| JP | A-09-220720 | | 8/1997 |
| JP | 2004-261764 | A | 9/2004 |

* cited by examiner

*Primary Examiner*—Jiping Lu
(74) *Attorney, Agent, or Firm*—Birch, Stewart Kolasch & Birch, LLP

(57) ABSTRACT

A process for the continuous drying of water-surrounded granulate transported by a screen-type belt conveyor. In a first conveying region in the form of a chute, water is withdrawn under gravity from the plastic granulate at a temperature of > than 100° C., wherein, in a following second region on a belt conveyor, any remaining water is substantially removed by air extraction through the belt conveyor, the air extraction taking place at an air speed of > than 20 m per second and with a dwell time in the second region of < than 2 seconds, there being a following third region, as an evaporation zone, with a dwell time of more than two seconds.

10 Claims, 1 Drawing Sheet

PROCESS FOR THE CONTINUOUS DRYING OF WATER-SURROUNDED GRANULATE

BACKGROUND OF THE INVENTION

1.Field of the Invention

The invention relates to a process for the continuous drying of water-surrounded granulate transported by a screen-type belt conveyor.

2.Description of Background Art

Such a process is disclosed in German patent specification 40 36 112, said process using thermal radiation. A further device for the same purpose is known from German patent specification 39 27 769, which describes that the separation of granulate and water is effected in that the granulate is caused to pass via a vibrating screen, the purpose of which is to ensure that the plastic granulate can be brought to a desired residual moisture content without subsequent drying after separation by the vibrating screen. In this process, the separation of granulate and water through sucking-out by means of a blower in order to produce an air stream is possible, if at all, only with a low air speed, because, at higher air speeds, the granulate is pressed against the vibrating screen with such force that, even with the vibrating screen in an inclined position, the gravity-induced displacement of the granulate along the vibrating screen is no longer possible.

SUMMARY AND OBJECTS OF THE INVENTION

Experience has shown, therefore, that the use of a vibrating screen does not always lead to the desired result. The object of the invention, therefore, is considerably to improve the drying process for plastic granulate while avoiding thermal radiation and, in particular, such that the tendency of said plastic granulate, during processing thereof, to cause wear on the respective processing machines is extensively avoided. The object of the invention is achieved in that, in a first conveying region, water is withdrawn under gravity from the plastic granulate at a temperature of > than 100° C., wherein, in a following second region on a belt conveyor, any remaining water is substantially removed by air extraction through the belt conveyor, the air extraction taking place at an air speed of > than 20 m per second and with a dwell time in the second region of < than 2 seconds, there being a following third region, as an evaporation zone, with a dwell time of more than two seconds.

On account of this design, first of all, the tendency of the plastic granulate to cause wear on the processing equipment is avoided in that no motion whatever, especially no vibrating motion, is imparted to the granulate, the granulate remaining at such a high temperature, namely > than 100° C., that, at the end of the process, there remains only a residual moisture content of < 0.1% through the effect of sensible heat.

In order to intensify the withdrawal of water, the granulate is advantageously distributed in a single layer for transport on the belt conveyor.

A further advantageous design of the process consists in that the air speed in the second region is given a value of > than 30 m per second. The temperature of the granulate in the first region may also be > than 120° C.

The plastic granulate may be a plastic granulate which is provided with abrasive fillers or strengtheners. On account of this design, the tendency of the plastic granulate to cause wear on the processing equipment is avoided in that no motion whatever, especially no vibrating motion, is imparted to the granulate.

Alternatively, the plastic granulate may be a plastic granulate which has a friction-sensitive surface. Since, during its drying, the granulate is not subjected to any movement, there are also no friction phenomena which might have a disadvantageous effect on the surface of the granulate.

In a further advantageous application, the plastic granulate is a plastic granulate which consists of a brittle material. Since, during drying, the plastic granulate is not subjected to any imparted movement, there is no risk of the granulate being exposed to friction or impact phenomena which might destroy the granulate because of the brittleness thereof.

A particularly advantageous design of the device for implementation of the process is provided when the belt conveyor is followed by a further belt conveyor, said further belt conveyor receiving plastic granulate from the first belt conveyor, said two belt conveyors being advantageously so designed that the second belt conveyor extends below the first belt conveyor and is loaded from the first belt conveyor under gravity.

An advantageous design of the belt conveyors is provided when the transport angle of the belt conveyor is adjustable. A rise of the belt conveyor towards its discharge point is of interest especially to any downline equipment for receiving the dried granulate where such downline equipment is at a particular height and needs, therefore, to be loaded at such a height.

In order to make the gravity separation in the first region adjustable, it is advantageous to design the device such that said first region is adjustable with regard to its transport angle and its length. The first conveying region is advantageously in the form of a chute.

Further scope of applicability of the present invention will become apparent from the detailed, description given hereinafter. However, it should be understood that the detailed description and specific examples; while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The drawings present only schematic representations of the respective device, because the individual components are known arrangements.

Figure 1:
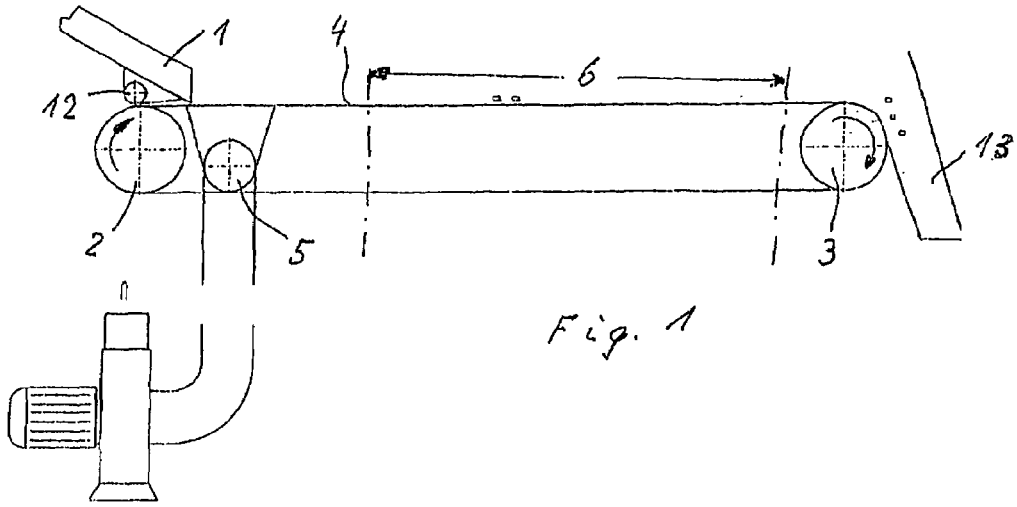
FIG. 1 shows a device with water separation under gravity before the granulate is transferred onto a belt conveyor provided in its initial region with air extraction.

FIG. 1 shows a chute 1 on which granulate produced by a granulator slides down under gravity at the temperature prevailing in the granulator, the bottom of the chute 1 being in the form of a screen, more particularly a slotted-hole screen, with the result that, in this region, a large proportion of the water surrounding the granulate upon production thereof is separated off through gravity. The transport angle of the chute 1 can be adjusted as desired by means of a carrying device 12 on which the chute 1 is supported.

Sliding off the chute 1, the granulate, thus in large part freed of water, then passes onto the conveyor belt 4, which is moved by the two conveyor rollers 2 and 3 and which is in the form of a travelling screen and is therefore permeable to both water and air. Consequently, the chute 1 is the first conveying region for the plastic granulate which, in the following second region on the belt conveyor 4, is subjected to further water removal in that air is sucked through the belt of the belt conveyor 4 at high speed by means of the blower 5 which thus almost completely removes the remaining surface water from the granulate. As the granulate is further transported on the belt conveyor 4, it then passes into the third region 6, where the granulate, further transported by the belt conveyor 4, loses its residual moisture content through an evaporation process owing to the temperature of over 100° C. which exists in the granulate in the first region and owing to the thereafter still relatively high temperature of the granulate, after which evaporation process, after the transport roller 3, the granulate finally falls into a shaft 13 from where it can be further processed as dried granulate.

Figure 2:
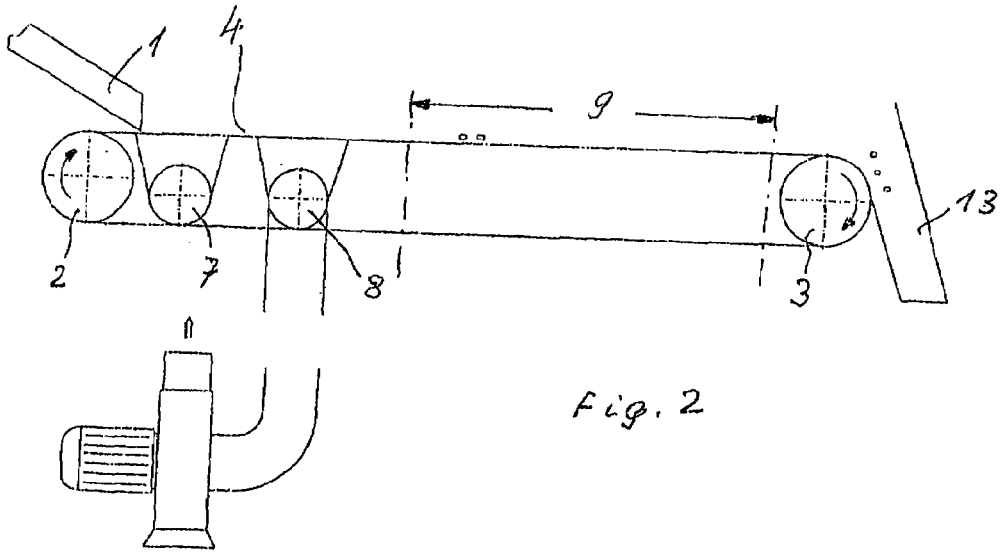
FIG. 2 shows a device with water separation under gravity through the belt conveyor.

The device presented in FIG. 2 is largely identical to that shown in FIG. 1. In FIG. 2, however, separation under gravity takes place not in the region of the chute 1, but in the region of the water separator 7, through which is discharged that water which flows off under gravity through the travelling-screen transport belt forming the belt conveyor 4. This first conveying region of the device shown in FIG. 2 is then adjoined by the second conveying region with the blower 8, which is largely identical to the blower 5 shown in FIG. 1, with the result that, in the second region with the blower 8, surface water is extensively separated from the granulate. After the blower 8, the third region 9 then acts as an evaporation region which is followed by the shaft 13, which serves as the exit point of the device.

Figure 3:
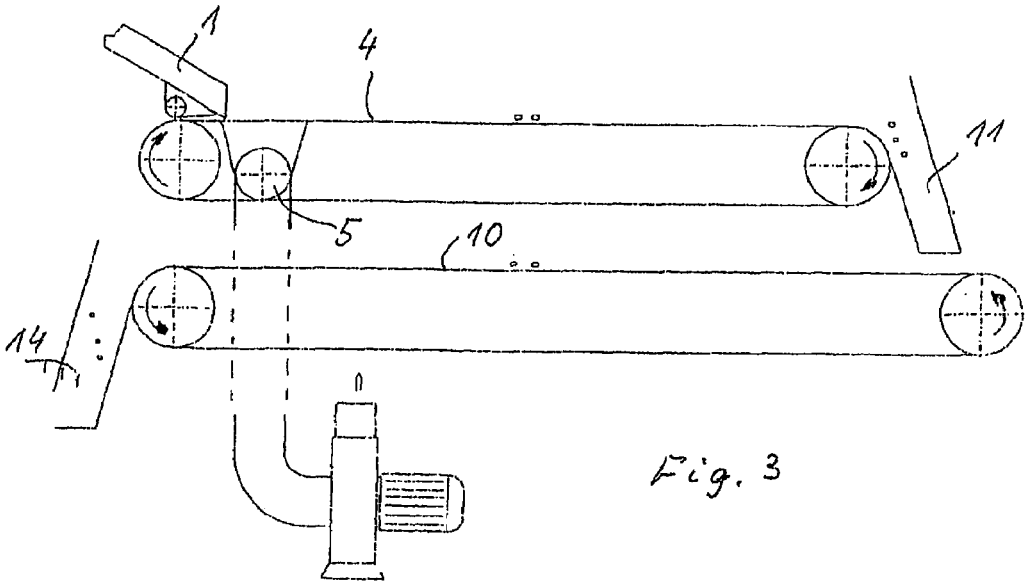
FIG. 3 shows a device with transfer of the pre-dried granulate on a first belt conveyor to a second belt conveyor as evaporation zone.

The device presented in FIG. 3 is largely identical to that shown in FIG. 2. In FIG. 3, however, the evaporation region is considerably longer owing to the fact that the belt conveyor 4 is followed by a further belt conveyor 10, which further belt conveyor 10 is supplied via the shaft 11 with the largely dry granulate, wherein, owing to the long evaporation zone on the belt conveyor 10, the granulate is, with a high degree of certainty, definitively dry upon leaving the device, this being effected via the shaft 14.

The invention being thus described, it will be obvious that The same may be varied in many ways. Such variations are not to be regarded as a departure from the spirit, and scope of the invention, and all such modifications as would be obvious to one skilled in the art are intended to be included within the scope of the following claims.

What is claimed is:

1. Process for continuous drying of water-surrounded plastic granulate transported by a screen-type belt conveyor (4, 10), comprising the following steps:

withdrawing water in a first conveying region in the form of a chute, water is withdrawn under gravity from a plastic granulate at a temperature of > than 100° C.;

extracting in a following second region on a belt conveyor (4), any remaining water wherein the water is substantially removed by air extraction (8) through the belt conveyor (4), the air extraction taking place at an air speed of > than 20 m per second and with a dwell time in the second region of < than 2 seconds; and evaporating in a third region (6, 9), as an evaporation zone, with a dwell time of more than 2 seconds.

2. Process according to claim 1, characterized in that the plastic granulate is distributed in a single layer for transport on the belt conveyor.

3. Process according to claim 2, characterized in that the air speed in the second region is greater than 30 m per second.

4. Process according to claim 2, characterized in that the temperature of the plastic granulate in the first region is greater than 120° C.

5. Process according to claim 1, characterized in that the air speed in the second region is greater than 30 m per second.

6. Process according to claim 5, characterized in that the temperature of the plastic granulate in the first region is greater than 120° C.

7. Process according to claim 1, characterized in that the temperature of the plastic granulate in the first region is greater than 120° C.

8. Process according to claim 1, characterized in that the plastic granulate is provided with abrasive fillers or strengthener.

9. Process according to claim 1, characterized in that the plastic granulate has a friction-sensitive surface.

10. Process according to claim 1, characterized in that the plastic granulate consists of a brittle material.

* * * * *